United States Patent [19]

Bruce

[11] Patent Number: 4,978,942

[45] Date of Patent: Dec. 18, 1990

[54] DISGUISED BEAM-BREAK SECURITY SYSTEM

[76] Inventor: Richard L. Bruce, Rte. 5, Box 60, Lawrence, Kans. 66046

[21] Appl. No.: 373,410

[22] Filed: Jun. 30, 1989

[51] Int. Cl.[5] ..... G08B 13/18

[52] U.S. Cl. ..... 340/556; 250/221; 340/693

[58] Field of Search ..... 340/556, 557, 693; 250/221

[56] References Cited

U.S. PATENT DOCUMENTS

| | | | |
|---|---|---|---|
| 3,205,482 | 9/1965 | Taylor, Jr. et al. | 340/693 |
| 3,619,629 | 11/1971 | Matthews | 250/221 |
| 3,688,298 | 8/1972 | Miller et al. | 340/557 |
| 3,711,846 | 1/1973 | Schlisser et al. | 340/557 |

*Primary Examiner*—Glen R. Swann, III

*Attorney, Agent, or Firm*—Hovey, Williams Timmons & Collins

[57] ABSTRACT

A station is provided with an external industrial container-shaped shell having a window therein for admitting the passage of a monitoring beam therethrough. The preferably infrared beam is initiated by a beam transmitter having a lens aimed at a corresponding beam receiver in a second station, the stations being adapted for employment in pairs. Interruption of the beam by either an intruder passing between the pair of stations or tampering with a barrel causes a signal to be transmitted to a remote alarm. The housing is designed to be inconspicuous so that an intruder will not locate the station and thereby avoid detection.

10 Claims, 3 Drawing Sheets

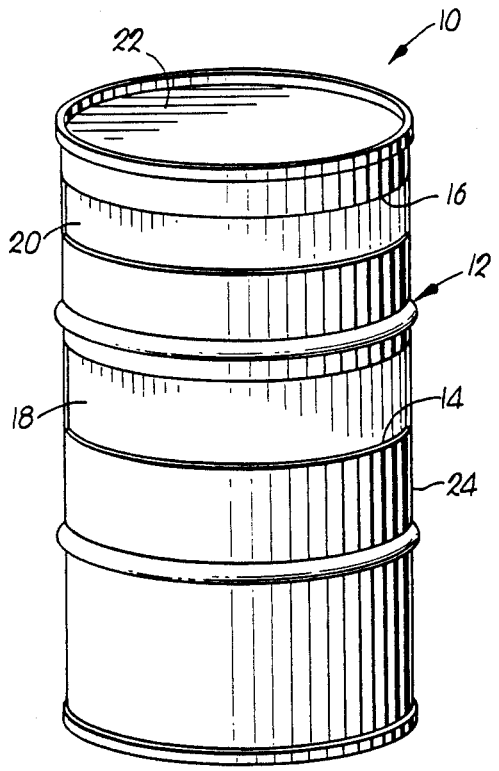
FIG. 1.
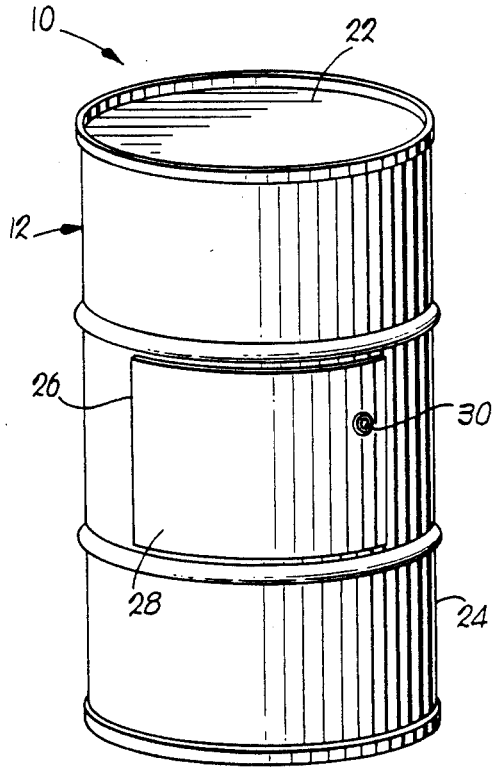
FIG. 2.
FIG. 3.
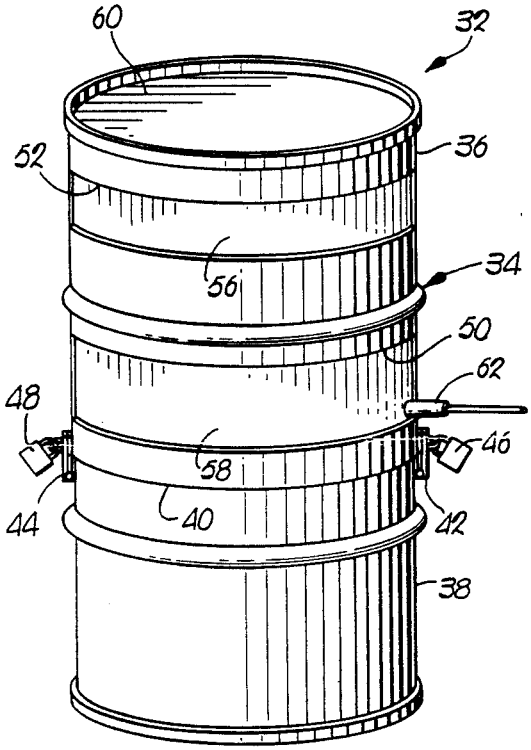
FIG. 4.
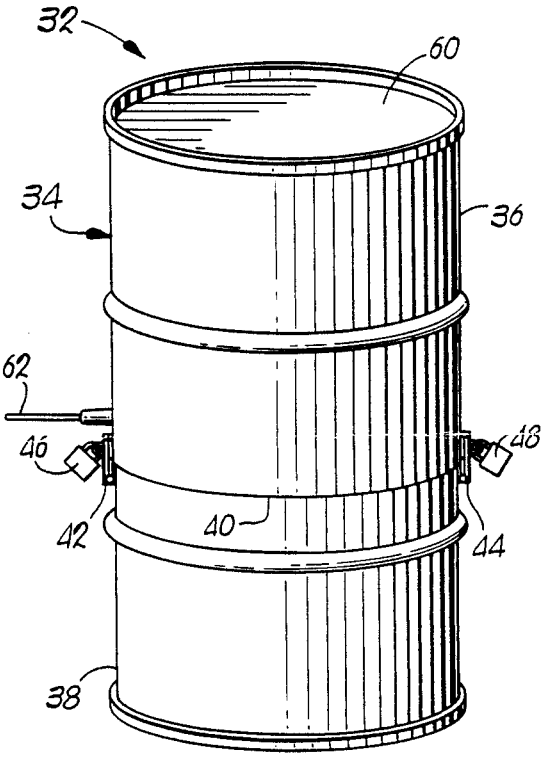

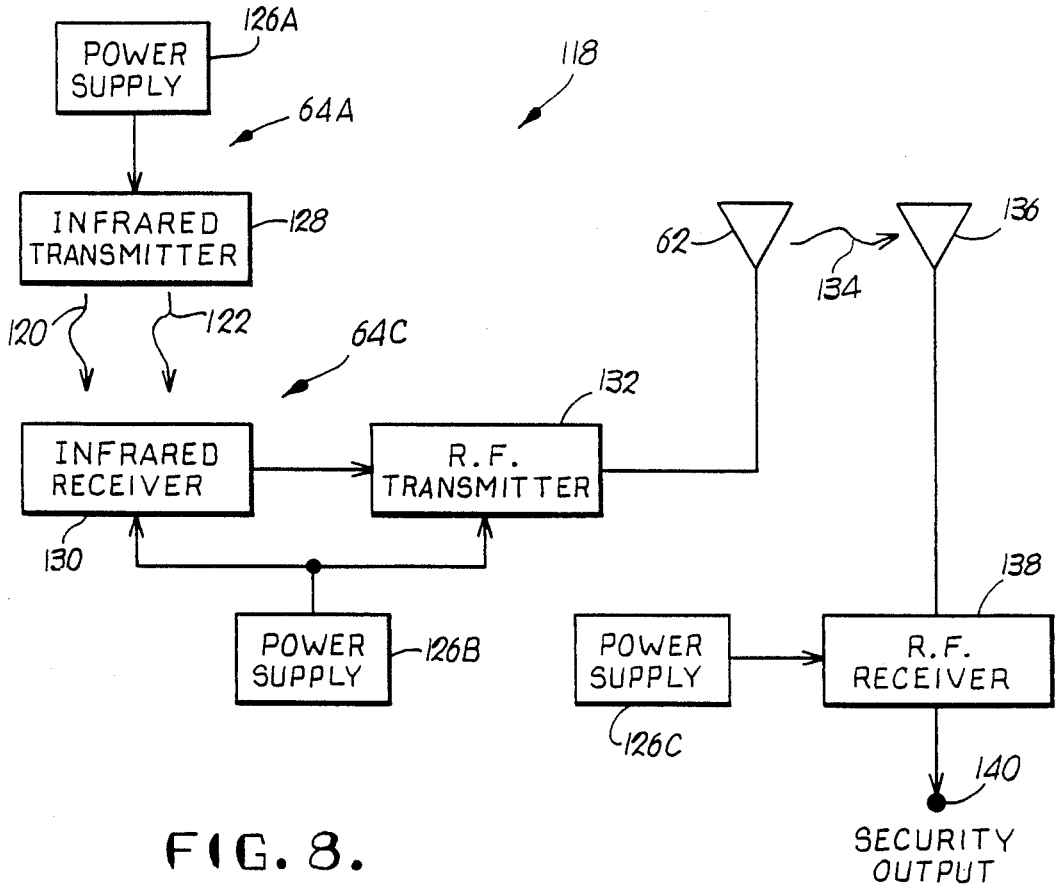
FIG. 8.
FIG. 9.
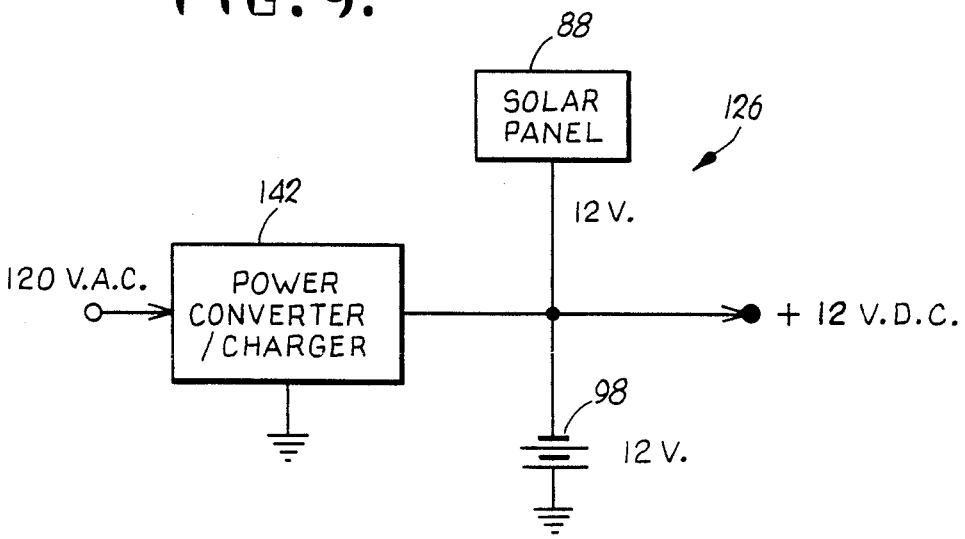

DISGUISED BEAM-BREAK SECURITY SYSTEM

BACKGROUND OF THE INVENTION

Field of the Invention

This invention relates to a security monitoring station of simple yet highly effective construction particularly useful in outdoor applications. The monitoring station hereof is adapted for remote usage and is provided with a rugged cylindrical shell which not only protects the internal electronic components but also is inconspicious to intruders. The station is adapted to be used in combination with at least one other station to pass an intrusion-detection beam therebetween. Interruption of the beam or tampering with the barrel results in activation of an alarm at a remote location.

Description of the Prior Art

There is an ever-increasing need to provide effective security for remote locations. This is particularly true at construction sites, where large quantities of valuable construction materials or expensive tools may be stored. Theft and vandalism occur at these targets of opportunity, as well as parking lots, resort homes, or other areas which may be unoccupied at night or on weekends.

It has heretofore been very difficult to provide effective security at these sites at a reasonable cost. Guard and protection services may prove too expensive to provide an on-site presence on a round-the-clock basis. Even if physically present, the guard may be inattentive or even bribed to ignore intruders. Vandals and thieves will then strike at these sites at night, under cover of darkness, increasing expenses which are borne by the property owner, contractor or eventual consumer.

SUMMARY OF THE INVENTION

The problems outlined above are in large measure solved by the security monitoring station of the present invention which is adapted for remote use in an outdoor environment whereby the electronic components may be both protected and camouflaged.

The security monitoring station in accordance with the present invention broadly includes a transmitter or receiver of an electromagnetic beam, a radio signal transmitter associated with the receiver, power supply means connected to the transmitter or receiver, and a housing for encasing and protecting the beam receiver or beam transmitter, radio transmitter and power supply. The housing includes an industrial drum-shaped shell presenting at least one, and preferably two openings therein. The openings are vertically spaced apart and covered with a translucent, but preferably not transparent window. The windows are preferably elongated, whereby an intruder may not determine the orientation of the beam from its external appearance.

The housing is preferably shaped like a conventional industrial container drum in order that the station may blend in with its surroundings. Access to the interior of the housing may be gained either by a lockable door in the side of the shell or alternatively by separating the housing into upper and lower components which may be locked together. This latter embodiment is especially useful for gaining access to the electronic components within the housing, as removal of the upper component yields free access to the electronic contents mounted the lower component therein. The bottom of the housing may be filled with concrete to anchor the station and to inhibit its movement by vandals.

The station hereof is preferably provided with a battery to power the eletronic components. The electrical drain of the electronic components is relatively low and the battery yields sufficient power to operate the station for extended periods in remote locations on an uninterrupted basis. The station may be additionally provided with a solar panel or a conventional alternating current charger/converter component for charging the battery and powering the unit.

The stations are to be employed in pairs with one station having a beam projector and the other a beam receiver. Alternatively, the stations may oriented in series. The stations preferably include a duplex projector and duplex receiver, whereby each of the spaced, parallel-oriented, preferably infrared beams must be interrupted to initiate an alarm signal. The use of at least two beams, one about 18 to 24 inches above the ground and the second about six to twelve inches thereâbove, avoids nuisance alerts by dogs and rodents but will effectively trigger the alarm upon the passage therethrough by a vehicle or human intruder.

BRIEF DESCRIPTION OF THE DRAWINGS

FIG. 1 is a perspective view of a first embodiment of the present invention showing the front side of the security monitoring station and the windows through .which the electromagnetic beams may pass;

FIG. 2 is a perspective view of the rear of the embodiment of the present invention shown in FIG. 1, showing the lockable rear access door;

FIG. 3 is a perspective view of a second embodiment of the present invention, showing an antenna projecting through the housing and locks securing the top upper and lower components;

FIG. 4 is a perspective view of the rear of the embodiment shown, in FIG. 3;

FIG. 8 is a schematic view of the electrical components incorporated in a security monitoring system; and FIG. 9 is a schematic view of the power supply system used to operate the electronic components hereof.

DETAILED DESCRIPTION OF THE DRAWINGS

Figure 5:
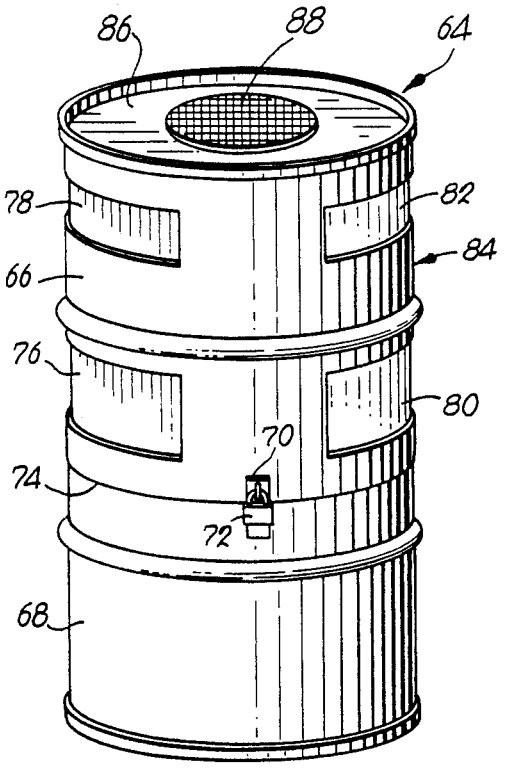
FIG. 5 is a perspective view of a third embodiment of the present invention having more than one set of windows therein.

Referring now to the drawings, a first embodiment of a security monitoring station 10 in accordance with the present invention is shown in FIG. 1, and includes broadly a housing 12 in the shape of an industrial container, preferably a conventional 35 or 55 gallon industrial drum. The housing 12 is preferably made of steel or other durable material, which is ordinarily opaque to most electromagnetic beams, such as infrared or microwave transmissions. Accordingly, the housing 12 presents openings 14 and 16 spaced vertically apart on the housing whereby electromagnetic beams may pass therethrough. The openings 14 and 16 are covered respectively by windows 18 and 20.

In more detail, housing 12 presents a circular top 22, substantially cylindrical sidewall 24, and a bottom which appears substantially as top 22.

As shown in FIG. 2, the wall 24 includes an access 26 covered by a door 28 provided with a lock 30. The door 28 is preferably pivotally mounted to wall 24 whereby access may be gained to the interior of the housing 12.

Windows 18 and 20 are preferably made of synthetic resin material which is optically translucent, or alternatively opaque, while admitting the transmission of an infrared, microwave or other beam therethrough. While windows 18 and 20 may be transparent, such transparency may allow an intruder to determine which of the security containers 10 are active and which are "dummy" containers, and thus a darkened translucent opaque window 18 or 20 is preferable. The windows 18 and 20 are vertically spaced apart, each preferably extending in an arc around the sidewall 24 of the container 12. In this manner, when the openings 14 and 16 and corresponding windows 18 and 20 are elongated, it is more difficult for an intruder to detect the direction of transmission of an electromagnetic beam therethrough. The first window 18 is preferably located approximately 12 to 30 inches above the ground, with the second window 20 being spaced 6 to 18 inches thereabove.

Turning now to FIG. 3, an alternate embodiment of a security monitoring station 32 is shown which has an appearance, at least from a distance, which is substantially similar to the security monitoring system 10 of the first embodiment. However, the housing 34 of security monitoring station 32 includes a normally upper component 36 which is removably mounted to normally lower component 38. A line of separation 40 defines the junction of upper component 36 and lower component 38. The upper component 36 may be fastened to lower component 38 by hasps 42 and 44 which may be secured by padlocks 46 and 48.

Security monitoring station 32 also includes openings 50 and 52 defined in sidewall 54 of upper component 36, as well as windows 56 and 58 similar to windows 18 and 20 described hereinabove. Upper component 36 is provided with a circular top 60. An antenna 62 extends externally to housing 34 transmitting an alarm signal to a remote receiver. Housing 34 also includes a bottom similar in appearance and construction to top 60. As shown in FIGS. 3 and 4, windows 56 and 58 extend in an elongated arc around housing 34 whereby the internal electronic components may be oriented to direct an electromagnetic beam therethrough.

Referring now to FIG. 5, a third embodiment of a security monitoring station 64 is similar to security monitoring station 32, including upper component 66 and lower component 68 which are separably joined by hasp 70 and padlock 72. Upper component 66 is separable from lower component 68 along a transverse circumscribing separation line 74. Security monitoring station 64 includes a first lower window 76 and a first upper window 78 as well as a second lower window 80 and a second upper window 82 and openings defined in housing 84. Housing 84 also includes a top 86 having a conventional photovoltaic solar panel 88 mounted thereon. Solar panel 88 may be one such as manufactured under the model Solarguard by Crime Stopper Security Products, Inc. of Simi Valley, California. Solar panel 88 is oriented to receive solar energy as shown in FIGS. 5 and 6.

Figure 6:
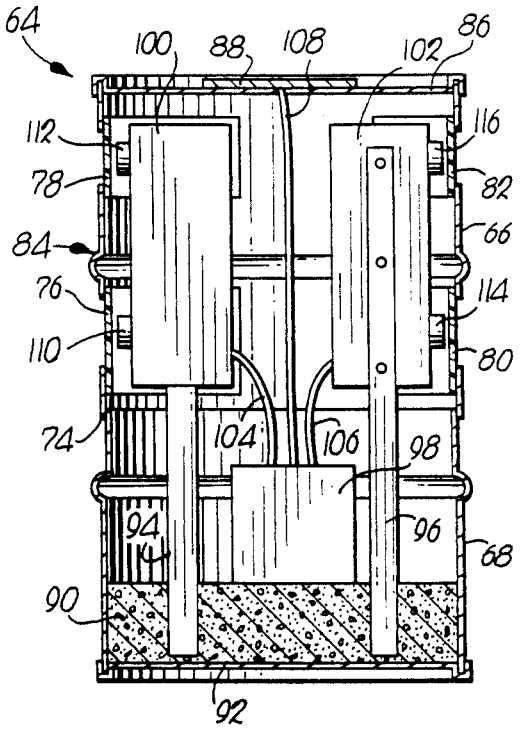
FIG. 6 is a vertical sectional view taken through the security monitoring station shown in FIG. 5, illustrating a location of the power source, anchor and beam handling apparatus within the housing.

Referring now to the internal components of the security monitoring station 64 as shown in FIG. 6, an anchor 90 of poured concrete overlies bottom 92 of housing 84. Anchor 90 serves to maintain security monitoring station 64 in an upright orientation and to prevent its dislocation by strong winds, as well as resisting tampering by unauthorized personnel by making it more difficult to move. A pair of supports 94 and 96 have a portion thereof placed in anchor 90 for maintaining the orientation of the electronic components thereon. A battery 98 serves to supply power to electronic beam handling components 100 and 102 and are connected by electric cables 104 and 106. Solar panel 88 is connected to battery 98 by electric cable 108, whereby the battery may be recharged during daylight hours. The battery 98 is preferably of a conventional, automotive 12-volt variety, although current drain on the system is such that smaller batteries such as motorcycle or small tractor batteries may be employed.

Electronic beam handling component 100 is shown as a duplex electronic beam projector having dual lenses 110 and 112 for directing an infrared beam through windows 76 and 78 respectively. Electronic beam handling component 102 is, on the other hand, an electronic beam handling receiver having receiving lenses 114 and 116 for receiving infrared beams projecting through windows 80 and 82 respectively. Electronic beam projector 100 and electronic beam receiver 102 are normally supplied as pairs as model number AX500T by Optex U.S.A., Inc. of Torrance, California. Electronic beam handling component 102 includes as well as a receiver, a radio alarm transmitter MR100T as supplied by Linear Corporation in Carlsbad, California. The radio transmitter may be connected to the infrared beam receiver as is conventionally provided for and will be easily understood by one of ordinary skill in the art. It is to be understood that security monitoring stations in accordance with the present invention may be provided only with electronic beam handling component 100, or alternatively electronic beam handling component 102, whereby the security monitoring stations may be provided as a mated pair, one having a electronic beam projector and the other an electronic beam receiver.

Figure 7:
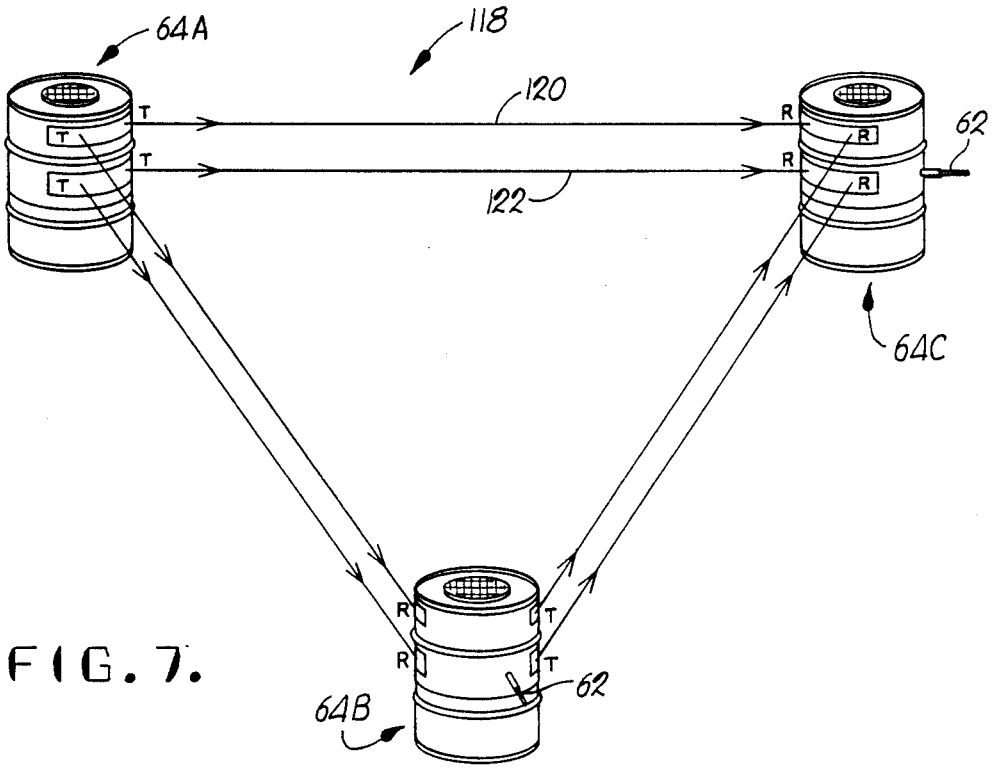
FIG. 7 is a perspective view showing a security monitoring system incorporating three separate stations.

Alternatively, as shown in FIG. 7, a single station may include two pairs of beam transmitters, two pairs of beam receivers, or one pair of receivers and one pair of transmitters. As shown in FIG. 7, each station 64A, 64B and 64C are adapted to cooperate with other stations whereby a security monitoring system 118 is provided. In the system shown in FIG. 7, all of the security monitoring stations 64 include active components, but it is to be understood that additional "dummy" security monitoring stations not containing electronic beam handling components might, be included as a deterant to intruders Preferably, as shown in FIG. 7, an upper beam 120 and a lower beam 122 are directed between adjacent stations, such as station 64A to 64C in the manner indicated by arrows in FIG. 7, whereby interruption of both beams is necessary in order to trigger the radio transmitter in station 64C having the receiver and radio alarm transmitter therewithin. As used in FIG. 7, the letter T indicates an electromagnetic beam transmitter for generating, e.g. infrared beams, while the letter R is used to identify the relative location corresponding electromagnetic beam receivers. In the present system, infrared beams are contemplated, but it is to be understood that visible light, microwave or radar beams might also be employed with similar effectiveness.

FIG. 8 illustrates the schematic diagram of a security monitoring system 118 hereof. A first security monitoring station 64A having either a housing 12, a housing 34 or a housing 84 includes a power supply 126A operably connected to an electromagnetic beam handling unit, shown herein as an infrared transmitter 128. As described hereinabove, one infrared transmitter useful in accordance with the present invention is supplied as Model AX500T by Optex U.S.A., Inc. of Torrance, California. The infrared transmitter is preferably of a duplex beam type, whereby two spaced, parallel electromagnetic beams, such as infrared beams 120 and 122 as shown in FIG. 7 are aimed at a corresponding infrared receiver 130 located in a second security monitoring station, such as 64C shown in FIG. 7.

The infrared receiver acts as an electronic beam handling component, and one model useful in accordance with the present invention is supplied by Optex U.S.A., Inc. of Torrance California as a component of Model No. AX500. The infrared receiver is connected to a radio frequency transmitter 132, with one useful model in accordance with the present invention being Model MR100T manufactured by Linear Corp. of Carlsbad, California. Both units are suitably provided with a source of electrical power, as by power supply 126B. The transmitter 132 is connected to an antenna 62 as will be appreciated by those skilled in the art. Antenna 62 in turn sends an alarm signal 134, which is ordinarily a radio signal. Alarm signal. 134 is in turn received by an antenna 136 connected to a radio frequency receiver, such as Model MR400R available from Linear Corp. of Carlsbad, California. Radio frequency reeiver 138 is similarly provided with a power supply 126C, and also connected to a security output 140 such as a telephone alert connection, alarm bell or the like, as those skilled in the art will appreciate.

Turning now to FIG. 9, an exemplary power supply 126 is shown having a variety of possible sources Some security monitoring stations may be proximate sources of 120-volt AC power, which may be directed through a conventional low Voltage power converter and charger 142 to convert the 120 volt AC incoming current to 12-volt DC output for supplying operating power and for charging battery 98. Similarly, a photovoltaic solar panel 88 generating a nominal 12-volt output may also be provided as a means for maintaining the charge on battery 98 and supplying operating power. Thus, the battery may be continually supplied with current from either the power converter/charger 142 which may be a conventional 1 amp trickle charger, as well as solar panel 88. In situations which are more remote from a source of 120-volt AC power, the power converter/-charger 142 may be eliminated, and the solar panel 88 and battery 98 serve to provide the sole source of power. Yet further, the solar panel may be eliminated, and it has been found that the battery 98 provides sufficient power to operate the security monitoring station hereof for periods in excess of six months.

In operation, several active security monitoring stations may be placed in line-of-sight relationship, as shown in FIG. 7, to provide a security monitoring system 118. Advantageously, the configuration of the housing of each of the particular configurations of security monitoring station 10, 32 and 64 serve to blend in with the surroundings of a commercial or industrial sight, whereby the presence of the monitoring stations will not be readily detected by intruders. Yet further, additional "dummy" security monitoring stations not having active electronic components may be interspersed with the active units, whereby an intruder, upon initially locating the devices, is unable to determine which are active and which are passive. Even further, the active units may be painted in dull colors or allowed to rust, while the passive units may be painted bright orange in order to attract the attention of any intruders who might thereafter overlook the presence of the active units.

In operation, the security monitoring stations are oriented with the lenses 78 and 110 of the beam transmitting components being directed towards a corresponding receiving lens 114 and 116 in order to create a cooperating beam transmitting and receiving pair such as station 64A and 64C as shown in FIG. 7. Two vertically spaced apart infrared beams 120 and 122, as shown in FIG. 7, are especially useful, in that dogs, birds, or other small animals may interrupt either the upper beam 120 or the lower beam 122, but will not usually interrupt both beams simultaneously, while a human intruder will generally interrupt both beams simultaneously. Upon the interruption of both beams, as detected by receiving beam handling component 102, radio frequency transmitter 132 sends an alarm signal 314 via antenna 62 to antenna 136 to a corresponding radio frequency receiver 138, whereby a security output 140 is generated notifying a guard service, police station or the like of the presence of the intruder so that the property may be safeguarded and an arrest effected.

A security monitoring system in accordance with the present invention is particularly effective in that it is able to function on a round-the-clock basis, but the radio frequency receiver 138 may be disconnected during normal daytime operations, such as when construction crews are operating in the area. However, at night, the property owner or supervisor may activate the receiver, and thereby activate the system 118 for detection of after-hours intruders. The housings 12, 34 and 84 as shown herein all appear as common industrial drums, and thus remain inconspicuous to an intruder, while encasing and protecting the electronic components housed therewithin from weather, tampering by vandals, or the adverse effects of the sun. When use at the site to be protected is no longer desired, the stations may be removed by forklift, handtruck, or other means for reuse at a different site.

I claim:

1. A security monitoring station comprising:

means for handling an electromagnetic beam directed on a beam path;

means for supplying electrical power to said beam-handling means; and a housing surrounding said beam-handling and power supply means, said housing including structure presenting the appearance of an industrial container, said structure defining at least one opening for the passage of said electromagnetic beam along said path therethrough, said housing including a bottom and anchor means overlying said bottom within said housing.

2. A security monitoring station as set forth in claim 1, said anchor means comprising a quantity of concrete.

3. A security monitoring station comprising:

means for handling an electromagnetic beam directed on a beam path;

means for supplying electrical power to said beam-handling means; and a housing surrounding said beam-handling and power supply means, said housing including structure presenting the appearance of an industrial container, said structure defining at least one opening for the passage of said electromagnetic beam along said path therethrough, said housing including a first normally lower component and a removable second normally upper component releasably mounted on said lower component.

4. A security monitoring station as set forth in claim 4, said handling means and said power supply means being mounted on said lower component.

5. A security monitoring station as set forth in claim 4, including structure for locking said upper component to said lower component.

6. A security monitoring station comprising:

means for handling an electromagnetic beam directed on a beam path;

means for supplying electrical power to said beam-handling means; and a housing surrounding said beam-handling and power supply means, said housing including structure presenting the appearance of an industrial container, said structure defining at least one opening for the passage of said electromagnetic beam along said path therethrough, said housing presenting the appearance of an industrial drum.

7. A disguised security system comprising a plurality of stations presenting the appearance of industrial containers, at least some of said stations including active electromagnetic beam-handling units, said stations having a window therein, at least some of said active stations being oriented for the transmission of an electromagnetic beam through windows of cooperative pairs of said active stations, there being no externally visible sign as to which of said stations have active beam-handling units therewithin.

8. A disguised security system as set forth in claim 7, each of said active stations including upper and lower beam-handling units for directing a plurality of beams between cooperative pairs of active stations along spaced parallel paths, and including means for transmitting an alarm signal upon simultaneous interruption of each of said parallel beams.

9. A disguised security system as set forth in claim 8, wherein at least some of said beam-handling units of said active stations include means for both transmitting and receiving an electromagnetic beam.

10. A security monitoring station adapted for remove use comprising:

an electronic beam-handling component;

a housing containing said electronic beam-handling component, said housing including structure defining a window for passage of an electronic beam therethrough; and a source of electrical power contained within said housing, said source enabling said station to operate as a freestanding unit.

* * * * *